US011707125B1

(12) United States Patent
Garey et al.

(10) Patent No.: US 11,707,125 B1
(45) Date of Patent: Jul. 25, 2023

(54) SCALP APPLICATOR

(71) Applicants: Colleen Garey, Lake Mary, FL (US); Keesha Morgan, Lake Mary, FL (US)

(72) Inventors: Colleen Garey, Lake Mary, FL (US); Keesha Morgan, Lake Mary, FL (US)

( * ) Notice: Subject to any disclaimer, the term of this patent is extended or adjusted under 35 U.S.C. 154(b) by 93 days.

(21) Appl. No.: 17/164,894

(22) Filed: Feb. 2, 2021

(51) Int. Cl.
*A45D 24/26* (2006.01)
*A45D 24/10* (2006.01)

(52) U.S. Cl.
CPC ..... *A45D 24/26* (2013.01); *A45D 24/10* (2013.01)

(58) Field of Classification Search
CPC ..... A45D 24/26; A45D 24/10
USPC ..... 132/112, 113, 114
See application file for complete search history.

(56) References Cited

U.S. PATENT DOCUMENTS

| | | | | | |
|---|---|---|---|---|---|
| 718,054 | A * | 1/1903 | Head | A45D 24/00 | 119/606 |
| 3,101,086 | A * | 8/1963 | Di Vito | A45D 24/26 | 138/44 |
| 3,477,447 | A | 11/1969 | Eldredge | | |
| 4,213,473 | A | 7/1980 | Dawson | | |
| 5,054,504 | A | 10/1991 | Winrow | | |
| 5,307,825 | A * | 5/1994 | Smith | A45D 24/00 | 132/200 |
| 5,311,887 | A | 5/1994 | Ramsey | | |
| 5,913,314 | A | 6/1999 | Garrett | | |
| 6,035,806 | A | 3/2000 | Lorenzo | | |
| D450,884 | S | 11/2001 | Yoshida | | |
| 2002/0020421 | A1 * | 2/2002 | Vayrette | A45D 19/02 | 132/114 |
| 2006/0130865 | A1 * | 6/2006 | Blyden | A45D 24/10 | 132/118 |

FOREIGN PATENT DOCUMENTS

| | | | | |
|---|---|---|---|---|
| EP | 1002477 | | 5/2000 | |
| FR | 2779923 | A1 * | 12/1999 | A01K 13/002 |
| FR | 2810857 | A1 * | 1/2002 | A45D 19/02 |
| WO | WO-0049905 | A2 * | 8/2000 | A45D 19/02 |
| WO | WO-2010051556 | A2 * | 5/2010 | A45D 19/0008 |

* cited by examiner

*Primary Examiner* — Nicholas D Lucchesi
(74) *Attorney, Agent, or Firm* — Kyle A. Fletcher, Esq.

(57) ABSTRACT

The scalp applicator is configured for use with a liquid phase cosmetic media. The scalp applicator is a tool that applies the liquid phase cosmetic media to the head of a patient. The scalp applicator comprises a manifold and a bellows. The manifold is the working element of the tool formed by the scalp applicator. The manifold discharges the liquid phase cosmetic media onto the hair and scalp of the patient. The bellows forms the handle of the scalp applicator. The bellows contains the liquid phase cosmetic media. The bellows is a compressible structure. The compression of the bellows generates the motive forces necessary to force the liquid phase cosmetic media through the manifold for discharge.

16 Claims, 5 Drawing Sheets

SCALP APPLICATOR

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of hairdressing equipment including combs with dispensing devices for liquids, pastes, and powders. (A45D24/22)

SUMMARY OF INVENTION

The scalp applicator is configured for use with a liquid phase cosmetic media. The scalp applicator is a tool that applies the liquid phase cosmetic media to the head of a patient. The scalp applicator comprises a manifold and a bellows. The manifold is the working element of the tool formed by the scalp applicator. The manifold discharges the liquid phase cosmetic media onto the hair and scalp of the patient. The bellows forms the handle of the scalp applicator. The bellows contains the liquid phase cosmetic media. The bellows is a compressible structure. The compression of the bellows generates the motive forces necessary to force the liquid phase cosmetic media through the manifold for discharge.

These together with additional objects, features and advantages of the scalp applicator will be readily apparent to those of ordinary skill in the art upon reading the following detailed description of the presently preferred, but nonetheless illustrative, embodiments when taken in conjunction with the accompanying drawings.

In this respect, before explaining the current embodiments of the scalp applicator in detail, it is to be understood that the scalp applicator is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the scalp applicator.

It is therefore important that the claims be regarded as including such equivalent construction insofar as they do not depart from the spirit and scope of the scalp applicator. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
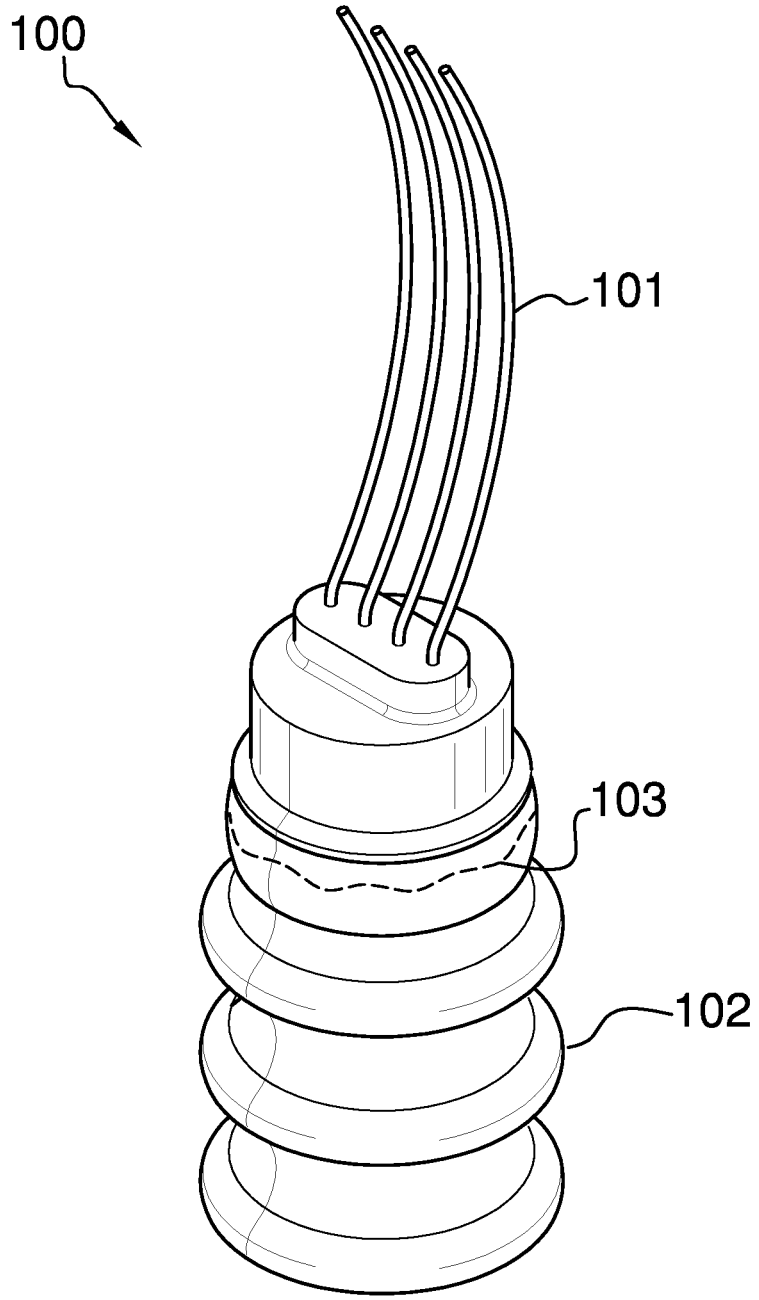
FIG. 1 is a perspective view of an embodiment of the disclosure.
Figure 2:
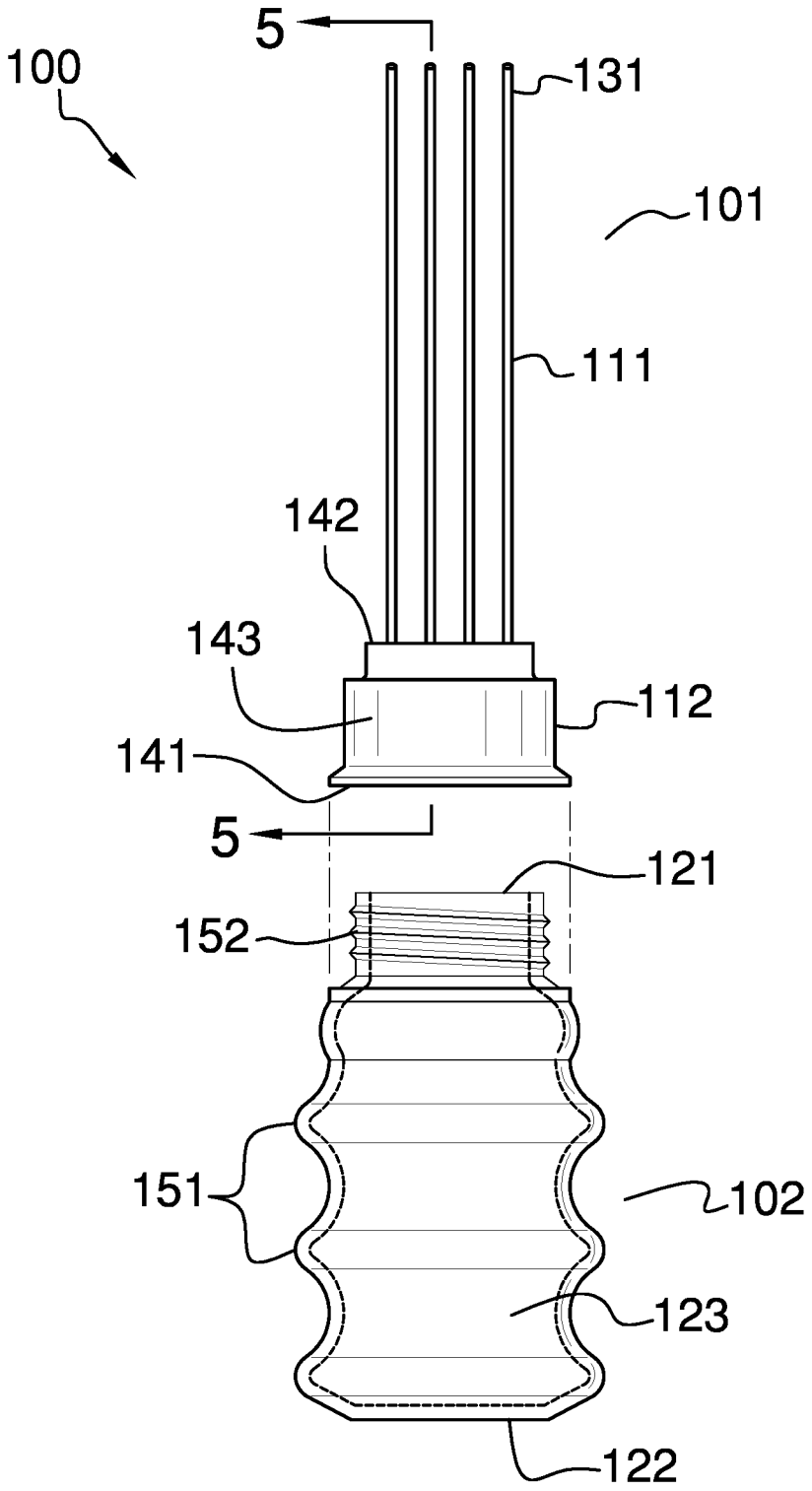
FIG. 2 is a front view of an embodiment of the disclosure.
Figure 3:
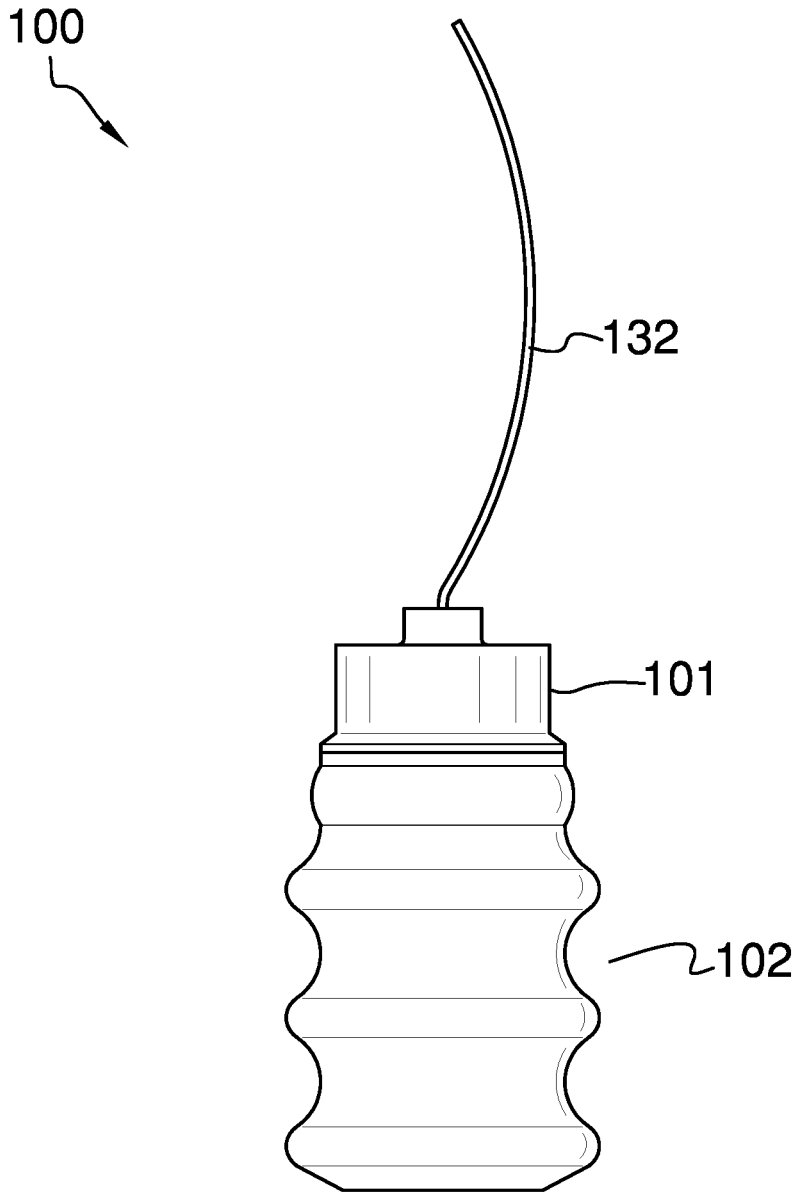
FIG. 3 is a side view of an embodiment of the disclosure.
Figure 4:
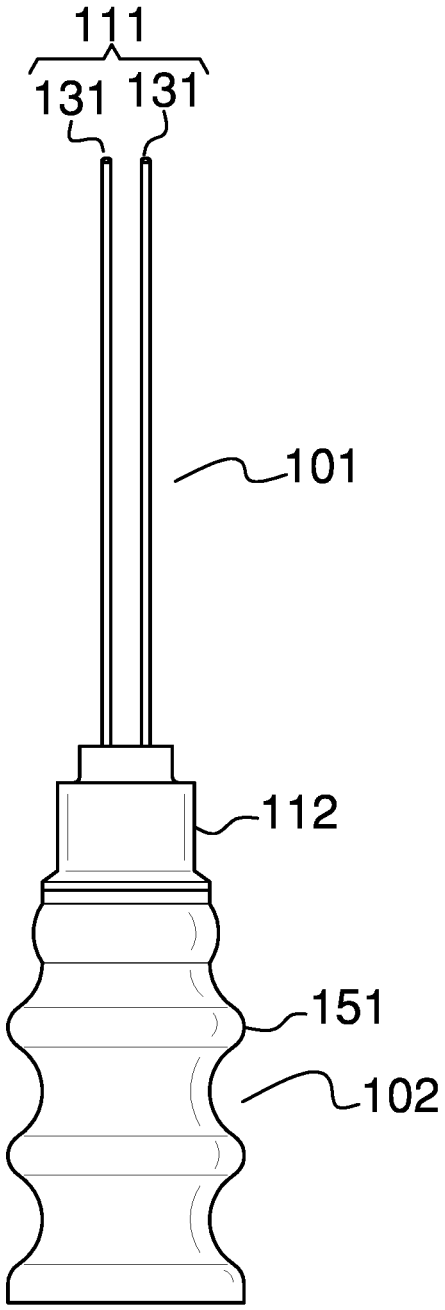
FIG. 4 is a front view of an alternate embodiment of the disclosure.
Figure 5:
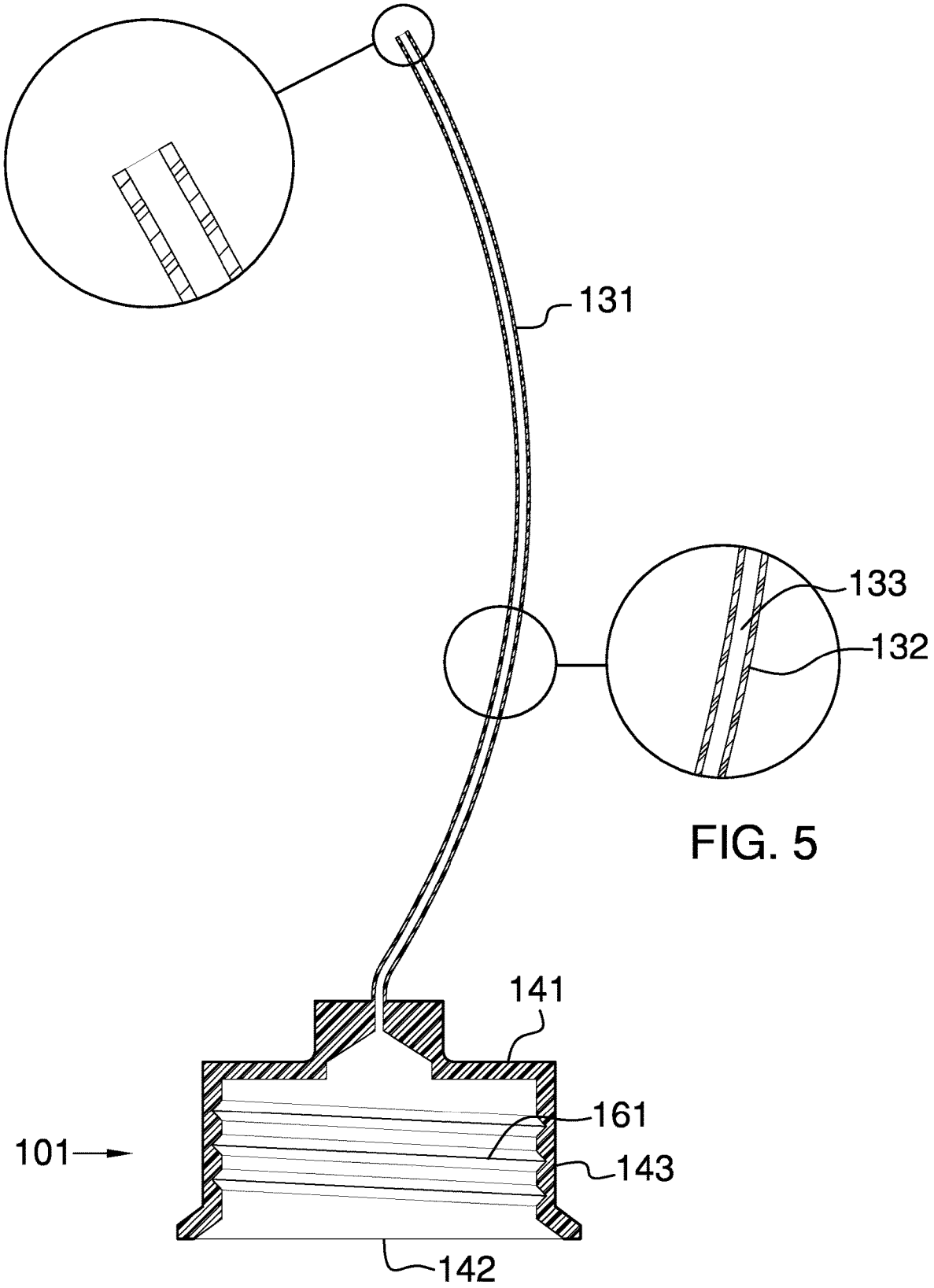
FIG. 5 is a cross-sectional view of an embodiment of the disclosure across 5-5 as shown in FIG. 2.

Detailed reference will now be made to one or more potential embodiments of the disclosure, which are illustrated in FIGS. 1 through 5.

The scalp applicator 100 (hereinafter invention) is configured for use with a liquid phase cosmetic media 103. The invention 100 is a tool that applies the liquid phase cosmetic media 103 to the head of a patient. The invention 100 comprises a manifold 101 and a bellows 102. The manifold 101 is the working element of the tool formed by the invention 100. The manifold 101 discharges the liquid phase cosmetic media 103 onto the hair and scalp of the patient. The bellows 102 forms the handle of the invention 100. The bellows 102 contains the liquid phase cosmetic media 103. The bellows 102 is a compressible structure. The compression of the bellows 102 generates the motive forces necessary to force the liquid phase cosmetic media 103 through the manifold 101 for discharge.

The liquid phase cosmetic media 103 is a cosmetic media. The terms liquid, phase, and cosmetic media are defined elsewhere in this disclosure.

The manifold 101 forms the working element of the tool formed by the invention 100. The manifold 101 receives the liquid phase cosmetic media 103 under pressure from the bellows 102. The manifold 101 discharges the received liquid phase cosmetic media 103 from the invention 100. The manifold 101 comprises a plurality of teeth 111 and a manifold 101 pan 112.

The plurality of teeth 111 forms the fluid distribution network of the invention 100. The plurality of teeth 111 receives the liquid phase cosmetic media 103 under pressure from the manifold 101 pan 112 and transports the liquid phase cosmetic media 103 for discharge. The plurality of teeth 111 comprises a collection of individual teeth 131.

Each individual tooth 131 selected from the plurality of teeth 111 is a prism-shaped structure. Each selected individual tooth 131 is a hollow structure. Each selected individual tooth 131 forms a tubular structure that transports the liquid phase cosmetic media 103 from the manifold 101 pan 112 to the discharge point. Each selected individual tooth 131 is formed as a non-Euclidean prism structure 132. Each individual tooth 131 comprises a non-Euclidean prism structure 132 and a transport channel 133.

The non-Euclidean prism structure 132 forms the tubular structure of each individual tooth 131. The non-Euclidean prism structure 132 is formed with two open congruent ends. The non-Euclidean prism structure 132 inserts into the hair of the patient in the manner of a comb such that the hair fits into the diastema of the plurality of teeth 111. The non-Euclidean prism structure 132 discharges the received liquid phase cosmetic media 103 into the hair and on the scalp of the patient. A congruent end of the non-Euclidean prism structure 132 of the individual tooth 131 attaches to the bellows 102 closed face 122. The non-Euclidean prism structure 132 attaches to the bellows 102 closed face 122 such that the non-Euclidean prism structure 132 forms a fluidic connection between the pan structure of the bellows 102 and the transport channel 133 of the individual tooth 131.

The transport channel 133 is the hollow interior formed within the non-Euclidean prism structure 132. The transport channel 133 transports the liquid phase cosmetic media 103 through the non-Euclidean prism structure 132 to the open congruent end of the non-Euclidean prism structure 132 that is distal from the manifold 101 pan 112. The transport channel 133 discharges the transported liquid phase cosmetic media 103 into the hair and on the scalp of the patient.

The manifold 101 pan 112 is a prism-shaped structure. The manifold 101 pan 112 has a pan shape. The manifold 101 pan 112 is a hollow structure. The manifold 101 pan 112 is a lid that encloses the bellows 102 open face 121 of the manifold 101 lateral face 143. The manifold 101 pan 112 receives the liquid phase cosmetic media 103 under pressure from the bellows 102 and transports the received liquid phase cosmetic media 103 into the plurality of teeth 111. The manifold 101 pan 112 comprises a manifold 101 open face 141, a manifold 101 closed face 142, and a manifold 101 lateral face 143.

The manifold 101 open face 141 is the open face of the pan structure of the manifold 101. The manifold 101 open face 141 is a congruent end of the prism structure of the manifold 101. The manifold 101 closed face 142 is the closed face of the pan structure of the manifold 101. The manifold 101 closed face 142 is a congruent end of the prism structure of the manifold 101. The manifold 101 closed face 142 is the face of the manifold 101 that is distal from the manifold 101 open face 141.

The manifold 101 lateral face 143 is the lateral face of the pan structure of the manifold 101. The manifold 101 lateral face 143 forms the boundary surfaces of the pan structure of the manifold 101 between the manifold 101 open face 141 and the manifold 101 closed face 142. The manifold 101 lateral face 143 comprises an interior screw thread 161. The interior screw thread 161 is a screw thread that is formed on the interior surface of the manifold 101 lateral face 143 at a position proximal to the manifold 101 open face 141.

The bellows 102 is a mechanical structure. The bellows 102 is a flexible structure. The bellows 102 is a prism-shaped structure. The bellows 102 has a pan shape. The bellows 102 forms the containment structure that stores the liquid phase cosmetic media 103.

The bellows 102 is a collapsible structure. By collapsible structure is meant that the span of the length of the center axis of the pan structure of the bellows 102 is adjustable. The bellows 102 collapses when a force is applied to the bellows 102 in a direction parallel to the center axis of the pan structure of the bellows 102. The collapse of the bellows 102 reduces the containment volume formed by the pan structure of the bellows 102. The reduction of the volume of the bellows 102 increases the pressure on the liquid phase cosmetic media 103 contained within the bellows 102. This increase in pressure on the liquid phase cosmetic media 103 caused by the compression of the bellows 102 generates the motive forces that drives the liquid phase cosmetic media 103 through the manifold 101.

The bellows 102 comprises a bellows 102 open face 121, a bellows 102 closed face 122, and a bellows 102 lateral face 123.

The bellows 102 open face 121 is the open face of the pan structure of the bellows 102. The bellows 102 open face 121 is a congruent end of the prism structure of the bellows 102. The bellows 102 closed face 122 is the closed face of the pan structure of the bellows 102. The bellows 102 closed face 122 is a congruent end of the prism structure of the bellows 102. The bellows 102 closed face 122 is the face of the bellows 102 that is distal from the bellows 102 open face 121.

The bellows 102 lateral face 123 is the lateral face of the pan structure of the bellows 102. The bellows 102 lateral face 123 forms the boundary surfaces of the pan structure of the bellows 102 between the bellows 102 open face 121 and the bellows 102 closed face 122. The bellows 102 lateral face 123 forms the flexible structure of the bellows 102 that allows the bellows 102 lateral face 123 to collapse. By collapsing the bellows 102, the bellows 102 lateral face 123 reduces the volume within the bellows 102 which increases the pressure on the liquid phase cosmetic media 103 within the bellows 102. The reduced volume of the bellows 102 increases the pressure on the liquid phase cosmetic media 103 within the bellows 102 such that the liquid phase cosmetic media 103 is pumped into the manifold 101 pan 112.

The bellows 102 lateral face 123 further comprises a bellows 102 accordion fold 151 and an exterior screw thread 152. The bellows 102 accordion fold 151 is a mechanical structure used to collapse and expand the volume of the bellows 102. The bellows 102 accordion fold 151 reduces the volume of the bellows 102 lateral face 123 by collapsing bellows 102 in a direction parallel to the center axis of the pan structure of the bellows 102. The exterior screw thread 152 is a screw thread that is formed on the exterior surface of the bellows 102 lateral face 123 at a position proximal to the bellows 102 open face 121. The exterior screw thread 152 secures the bellows 102 to the manifold 101 by screwing into the interior screw thread 161 to form a threaded connection.

The following definitions were used in this disclosure:

Accordion Fold: As used in this disclosure, an accordion fold is a corrugated structure that resembles the bellows of an accordion.

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Bellows: As used in this disclosure, a bellows refers to a hollow mechanical structure designed such that the interior volume of the hollow mechanical structure will change as the bellows performs its function.

Capped Tube: As used in this disclosure, a capped tube is a tube with one closed end and one open end.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Collapsible: As used in this disclosure, the terms collapsible refers to an object that is configured such that the volume of the object is adjustable. By volume is meant the volume of the perimetrical boundary that contains the object. The verb collapse means that the volume of the object is adjusted from a larger volume to a smaller volume. The verbs expand and deploy mean that the volume of the object is adjusted from a smaller volume to a larger volume.

Comb: As used in this disclosure, a comb is a toothed device that is used for detangling or otherwise arranging hair. The comb comprises a shaft from which project a plurality of teeth. Each of the plurality of teeth is a rod that projects away from the shaft. The hair is placed in the diastema between each pair of adjacent teeth selected from the plurality of teeth.

Compress: In this disclosure, compress means to apply a forces to force a fixed mass of material into a smaller space.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Cosmetic Media: As used in this disclosure, a cosmetic media refers to a chemical substance that is topically applied to a biological organism. The purposes for a cosmetic media include, but are not limited to: a) cleaning the skin and the hair of the biological organism; b) changing the visual, olfactory, and tactile stimuli presented by the biological organism to other nearby biological organisms; and, c) the topical application of a pharmacologically active media.

Diastema: As used in this disclosure, a diastema is the space between two teeth.

Flexible: As used in this disclosure, flexible refers to an object or material that will deform when a force is applied to it but that will not necessarily return to its original shape when the deforming force is removed.

Flow: As used in this disclosure, a flow refers to the passage of a fluid past a fixed point. This definition considers bulk solid materials as capable of flow.

Fluid: As used in this disclosure, a fluid refers to a state of matter wherein the matter is capable of flow and takes the shape of a container it is placed within. The term fluid commonly refers to a liquid or a gas.

Fluidic Connection: As used in this disclosure, a fluidic connection refers to a tubular structure that transports a fluid from a first object to a second object. Methods to design and use a fluidic connections are well-known and documented in the mechanical, chemical, and plumbing arts.

Fluid Network: As used in this disclosure, a fluid network refers to a transport structure that: a) receives a fluid into the fluid network; b) transports the fluid through a series of pipes, valves, and manifolds; and, c) discharges the fluid from the fluid network.

Force: As used in this disclosure, a force refers to a net (or unopposed) measurable interaction that changes the direction of motion of an object, the velocity of motion of an object, the momentum of an object, or the stress within an object.

Form Factor: As used in this disclosure, the term form factor refers to the size and shape of an object.

Gas: As used in this disclosure, a gas refers to a state (phase) of matter that is fluid and that fills the volume of the structure that contains it. Stated differently, the volume of a gas always equals the volume of its container.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Grip: As used in this disclosure, a grip is an accommodation formed on or within an object that allows the object to be grasped or manipulated by a hand.

Handle: As used in this disclosure, a handle is an object by which a tool, object, or door is held or manipulated with the hand.

Liquid: As used in this disclosure, a liquid refers to a state (phase) of matter that is fluid and that maintains, for a given pressure, a fixed volume that is independent of the volume of the container.

Manifold: As used in this disclosure, a manifold is a pipe or chamber having several ports through which one or more fluids are gathered or distributed.

Negative Space: As used in this disclosure, negative space is a method of defining an object through the use of open or empty space as the definition of the object itself, or, through the use of open or empty space to describe the boundaries of an object.

Non-Euclidean Prism: As used in this disclosure, a non-Euclidean prism is a prism structure wherein the center axis of the prism lies on a non-Euclidean plane or is otherwise formed with a curvature.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan is are open.

Patient: As used in this disclosure, a patient is a person who is designated to receive a medical treatment, therapy or service. The term patient may be extended to an animal when used within the context of the animal receiving veterinary treatment or services.

Pedestal: As used in this disclosure, a pedestal is an intermediary load bearing structure that forms a load path between two objects or structures.

Perimeter: As used in this disclosure, a perimeter is one or more curved or straight lines that bounds an enclosed area on a plane or surface. The perimeter of a circle is commonly referred to as a circumference.

Pharmacologically Active Media: As used in this disclosure, a pharmacologically active media refers to a chemical substance that has a biochemical or physiological effect on a biological organism. Phase: As used in this disclosure, phase refers to the state of the form of matter. The common states of matter are solid, liquid, gas, and plasma.

Pressure: As used in this disclosure, pressure refers to a measure of force per unit area.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Screw: As used in this disclosure, to screw is a verb meaning: 1) to fasten or unfasten (unscrew) a threaded connection; or 2) to attach a helical structure to a solid structure.

Squeeze: As used in this disclosure, to squeeze means to compress an object by hand.

Teeth: As used in this disclosure, the teeth refer to a plurality of working elements of a tool that interact with an object in order to cut or align the object. An individual working element selected from the plurality of working elements is called a tooth.

Threaded Connection: As used in this disclosure, a threaded connection is a type of fastener that is used to join a first cylindrical object and a second cylindrical object together. The first cylindrical object is fitted with a first fitting selected from an interior screw thread or an exterior screw thread. The second cylindrical object is fitted with the remaining screw thread. The cylindrical object fitted with the exterior screw thread is placed into the remaining cylindrical object such that: 1) the interior screw thread and the exterior screw thread interconnect; and, 2) when the cylindrical object fitted with the exterior screw thread is rotated the rotational motion is converted into linear motion that moves the cylindrical object fitted with the exterior screw thread either into or out of the remaining cylindrical object. The direction of linear motion is determined by the direction of rotation.

Tool: As used in this disclosure, a tool is a device, an apparatus, or an instrument that is used to carry out an activity, operation, or procedure.

Topical: As used in this disclosure, topical is an adjective associated with a cosmetic media. Topical indicates that the cosmetic media is applied directly to the skin.

Tube: As used in this disclosure, a tube is a hollow prism-shaped device formed with two open congruent ends. The tube is used for transporting liquids (including bulk solids) and gases. The line that connects the center of the first congruent face of the prism to the center of the second congruent face of the prism is referred to as the center axis of the tube or the centerline of the tube. When two tubes share the same centerline they are said to be aligned. When the centerlines of two tubes are perpendicular to each other, the tubes are said to be perpendicular to each other. In this disclosure, the terms inner dimensions of a tube and outer dimensions of a tube are used as they would be used by those skilled in the plumbing arts.

Working Element: As used in this disclosure, the working element of a tool is the physical element on the tool that performs the actual activity, operation, or procedure the tool is designed to perform. For example, the cutting edge of a blade is the working element of a knife.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A scalp applicator comprising a manifold and a bellows;

wherein the manifold is a working element of a tool formed by the scalp applicator;

wherein the bellows forms a handle of the scalp applicator;

wherein the scalp applicator is configured for use with a liquid phase cosmetic media;

wherein the scalp applicator is a tool that applies the liquid phase cosmetic media;

wherein the manifold comprises a manifold open face, a manifold closed face, and a manifold lateral face;

wherein the manifold open face is an open face of a pan structure of the manifold;

wherein the manifold open face is a congruent end of a prism-shaped structure of the manifold;

wherein the manifold closed face is a closed face of a pan shape of the manifold;

wherein the manifold closed face is a congruent end of the prism-shaped structure of the manifold;

wherein the manifold closed face is a face of the manifold that is distal from the manifold open face;

wherein the manifold lateral face is a lateral face of the pan structure of the manifold;

wherein the manifold lateral face forms boundary surfaces of the pan structure of the manifold between the manifold open face and the manifold closed face.

2. The scalp applicator according to claim 1 wherein the manifold discharges the liquid phase cosmetic media;

wherein the bellows contains the liquid phase cosmetic media;

wherein the bellows is a compressible structure;

wherein the compression of the bellows generates the motive forces necessary to force the liquid phase cosmetic media through the manifold for discharge.

3. The scalp applicator according to claim 2 wherein the manifold has a pan shape;

wherein the manifold is a hollow structure;

wherein the manifold is a lid that encloses a bellows open face of the manifold lateral face;

wherein the manifold receives the liquid phase cosmetic media under pressure from the bellows and transports the received liquid phase cosmetic media into a plurality of teeth.

4. The scalp applicator according to claim 3 wherein the bellows is a mechanical structure;

wherein the bellows is a flexible structure;

wherein the bellows has a pan shape;

wherein the bellows forms a containment structure that stores the liquid phase cosmetic media.

5. The scalp applicator according to claim 4 wherein the bellows is a collapsible structure;

wherein by collapsible structure is meant that the span of the length of the center axis of a pan shape of the bellows is adjustable.

6. The scalp applicator according to claim 5 wherein the bellows collapses when a force is applied to the bellows in a direction parallel to the center axis of the pan shape of the bellows.

7. The scalp applicator according to claim 6 wherein the collapse of the bellows reduces the containment volume formed by the pan shape of the bellows;

wherein the reduction of the containment volume of the bellows increases the pressure on the liquid phase cosmetic media contained within the bellows;

wherein this increase in pressure on the liquid phase cosmetic media caused by the compression of the bellows generates the motive forces that drives the liquid phase cosmetic media through the manifold.

8. The scalp applicator according to claim 7 wherein the manifold includes a plurality of teeth;

wherein the plurality of teeth forms a fluid distribution network of the scalp applicator;

wherein the plurality of teeth receives the liquid phase cosmetic media under pressure from the manifold and transports the liquid phase cosmetic media for discharge.

9. The scalp applicator according to claim 8 wherein the bellows comprises a bellows open face, a bellows closed face, and a bellows lateral face;

wherein the bellows open face is an open face of a pan structure of the bellows;

wherein the bellows open face is a congruent end of the prism structure of the bellows;

wherein the bellows closed face is the closed face of the pan structure of the bellows;

wherein the bellows closed face is a congruent end of the prism-shaped structure of the bellows;

wherein the bellows closed face is a face of the bellows that is distal from the bellows open face;

wherein the bellows lateral face is a lateral face of a pan shape of the bellows;

wherein the bellows lateral face forms boundary surfaces of the pan shape of the bellows between the bellows open face and the bellows closed face;

wherein the bellows lateral face forms the flexible structure of the bellows that allows the bellows lateral face to collapse.

10. The scalp applicator according to claim 9 wherein the plurality of teeth comprises a collection of individual teeth;

wherein each selected individual tooth is a hollow structure;

wherein each selected individual tooth forms a tubular structure that transports the liquid phase cosmetic media from the manifold to a discharge point.

11. The scalp applicator according to claim 10 wherein each selected individual tooth is formed as a three-dimensional prism structure;

wherein each individual tooth comprises the three-dimensional prism structure and a transport channel;

wherein the three-dimensional prism structure forms the tubular structure of each individual tooth;

wherein the three-dimensional prism structure is formed with two open congruent ends;

wherein the three-dimensional prism structure inserts into the hair of a patient in the manner of a comb such that the hair fits into a diastema of the plurality of teeth;

wherein the three-dimensional prism structure discharges the received liquid phase cosmetic media into the hair and on the scalp of the patient;

wherein a congruent end of the three-dimensional prism structure of the individual tooth attaches to the bellows closed face;

wherein the three-dimensional prism structure attaches to the bellows closed face such that the three-dimensional prism structure forms a fluidic connection between the pan shape of the bellows and the transport channel of the individual tooth.

12. The scalp applicator according to claim 11 wherein the transport channel is a hollow interior formed within the three-dimensional prism structure;

wherein the transport channel transports the liquid phase cosmetic media through the three-dimensional prism structure to the open congruent end of the three-dimensional prism structure that is distal from the manifold;

wherein the transport channel discharges the transported liquid phase cosmetic media into the hair and on the scalp of the patient.

13. The scalp applicator according to claim 12 wherein the manifold lateral face comprises an interior screw thread;

wherein the interior screw thread is a screw thread that is formed on the interior surface of the manifold lateral face at a position proximal to the manifold open face.

14. The scalp applicator according to claim 13 wherein the bellows lateral face further comprises a bellows accordion fold;

wherein the bellows accordion fold is a mechanical structure used to collapse and expand the volume of the bellows.

15. The scalp applicator according to claim 14 wherein the bellows lateral face further comprises an exterior screw thread;

wherein the exterior screw thread is a screw thread that is formed on the exterior surface of the bellows lateral face at a position proximal to the bellows open face.

16. The scalp applicator according to claim 15 wherein the exterior screw thread secures the bellows to the manifold by screwing into the interior screw thread to form a threaded connection.

* * * * *